US005509442A

United States Patent [19]

Claycomb

[11] Patent Number: 5,509,442

[45] Date of Patent: Apr. 23, 1996

[54] MUD SAVER VALVE

[76] Inventor: Jackson R. Claycomb, 8215 Debbie Gay, Houston, Harris County, Tex. 77040

[21] Appl. No.: 412,296

[22] Filed: Mar. 28, 1995

[51] Int. Cl.[6] ..... E21B 21/10

[52] U.S. Cl. ..... 137/494; 166/321

[58] Field of Search ..... 137/494; 166/321; 251/58

[56] References Cited

U.S. PATENT DOCUMENTS

| | | | |
|---|---|---|---|
| 3,386,701 | 6/1968 | Potts | 166/330 |
| 3,398,928 | 8/1968 | Fredd | 166/321 |
| 3,606,927 | 9/1971 | True et al. | 166/321 |
| 3,743,015 | 7/1973 | Mott | 251/58 X |
| 3,941,348 | 3/1976 | Mott | 166/330 |
| 4,130,166 | 12/1978 | Akkerman et al. | 166/330 |
| 4,262,693 | 4/1981 | Giebeler | 166/321 |
| 4,372,391 | 2/1983 | Barrington et al. | 166/330 |
| 4,415,027 | 11/1983 | Russell | 166/321 |
| 4,508,173 | 4/1985 | Read | 166/330 |
| 4,535,968 | 8/1985 | Gano et al. | 251/58 |
| 4,537,383 | 8/1985 | Fredd | 251/58 |
| 4,562,888 | 1/1986 | Collet | 166/330 |

OTHER PUBLICATIONS

"Save Money: Make Dry Connections Automatically with the MUD SAVER™", Bulletin 110, Arrowhead Continental (© 1979).

"A Kelly Valve and Drill Pipe Safe Valve, KELLY-GUARD", Bulletin 6601, Hydril® Mechanical Products Division (Dec. 1981).

"Introducing The Compact A–Z Mud Saver Valve, We've cut the wet connection problem down to size.", A–Z International Tool Company, (© 1984).

"Break Clean With Aitco's Mud Saver Valve", American International Tool Co., Inc. (Undated).

"Swaco Mud Saver Valve™", Swaco Dresser (Undated).

"Mud–Check™ Kelly Valve Cuts Waste of Time, Mud", *Oil & Gas Journal,* Steve Woolley (Feb. 20, 1978).

"Drilco Mud–Chek™ Kelly Valve. Because Mud Belongs in the Hole, Not on the Floor.", Drilco Division of Smith International, Inc. (Undated).

*Primary Examiner*—Robert G. Nilson

*Attorney, Agent, or Firm*—N. Elton Dry

[57] ABSTRACT

A mud saver valve has been developed for controlling flow of drilling fluid through an upper portion of a drill string, the mud saver valve in one aspect has a tubular housing, a ball closure rotatably disposed within the tubular housing, the ball closure having a body, a flow channel therethrough, a first body side and a second body side opposite the first body side, a first lug projecting from the first body side and a second lug projecting from the second body side, a sleeve assembly movably disposed within the tubular housing, the sleeve assembly having a first and a second actuator e.g, dogs, to engage corresponding first and second lugs of the ball closure to open or close the ball closure in response to fluid pressure conditions as well as engagement and disengagement of the tubular housing with the drill pipe against the force of a coil spring disposed within the tubular housing.

26 Claims, 6 Drawing Sheets

FIG. 14
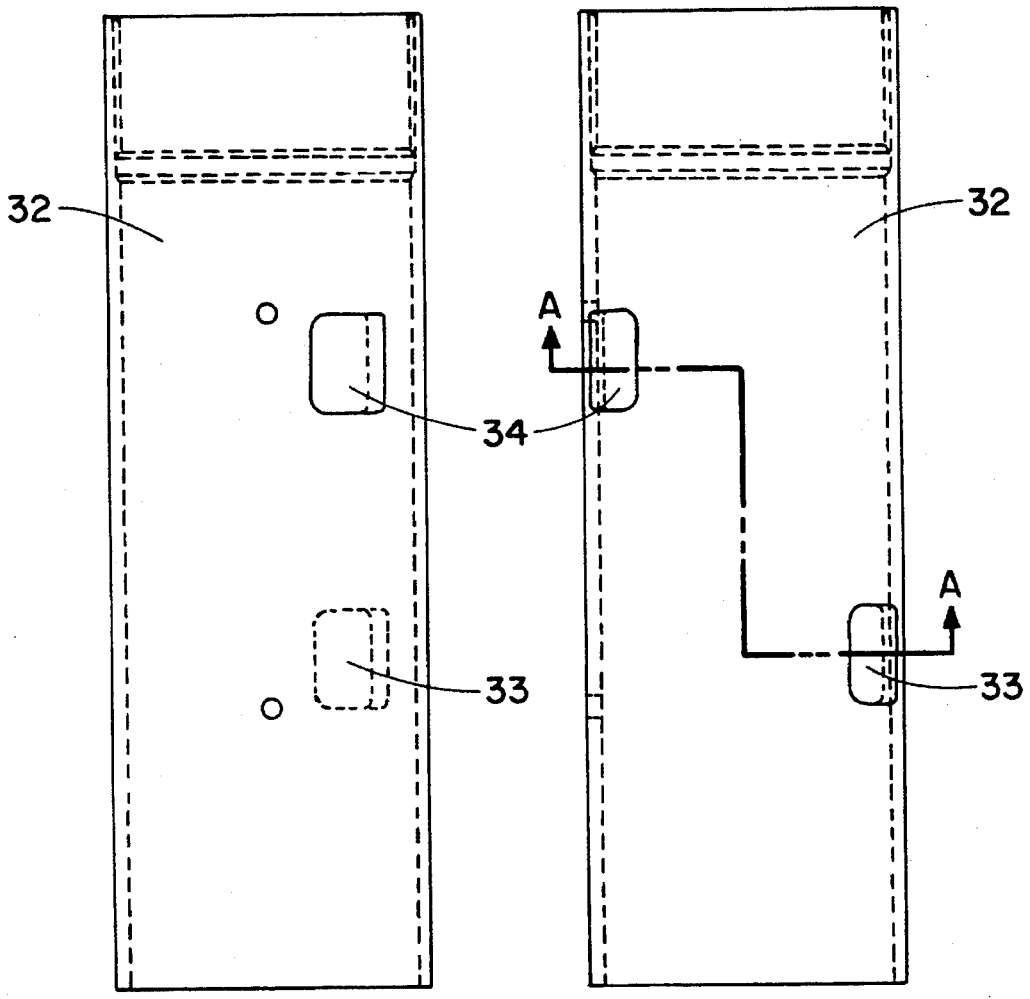
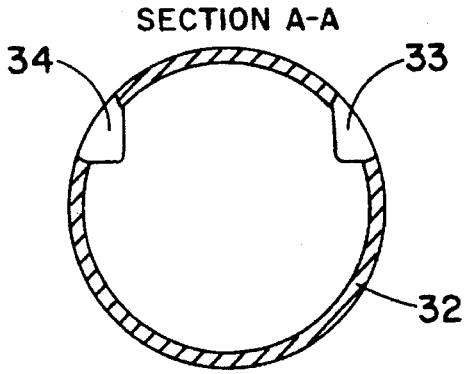
FIG. 15

MUD SAVER VALVE

BACKGROUND OF THE INVENTION

1. Field Of The Invention

This invention is related to mud saver valves for saving drilling fluid and, in one aspect, to such a valve installable below a kelly or similar apparatus in a drill string for saving drilling mud in the upper drill string while a new drill pipe connection is made.

2. Description of Related Art

During well drilling operations many joints of drill pipe are added to the drill string by first disconnecting an upper portion of the drill string, then installing a new piece of drill pipe by connecting it to the lower drill string and to the upper drill string. During such a connection procedure ("make-up") or during a similar disconnection procedure (or "break-out"), drilling mud within the upper drill string is lost unless some type of valve apparatus closes off the upper drill string, holding drilling mud therein.

Typical mud saver apparatuses are connected below a kelly and shut off drilling mud flow when mud pumps pumping the mud are turned off. The apparatus opens automatically when the mud pumps are again turned on. U.S. Pat. No. 4,262,693 discloses a kelly valve with a ball valve rotatably mounted in a tubular housing with a plurality of movable sleeves and a gear drive for controlling fluid flow through a kelly. These publications also disclose prior art mud saver apparatuses: "Mud Check (tm) Kelly Valve Cuts Waste of Time, Mud," OIL AND GAS JOURNAL, Feb. 20, 1978; "Drilco Mud-Check (tm) Kelly Valve," Drilco Division of Smith International, Inc.; "Swaco Mud Saver Valve," Swaco Division Dresser Industries, Inc.; "Break It Clean With Aitco's Mud Saver Valve," American International Tool Co., Inc.; "Introducing The Compact A-Z Mud Saver Valve," A-Z International Tool Company; "Kellyguard Bulletin 6601," Hydril Mechanical Products Division, 1981; "Make Dry connections Automatically With The Mud Saver (™)," Arrowhead Continental.

SUMMARY OF THE PRESENT INVENTION

The present invention, in one embodiment, discloses a drilling mud saver valve which is useful in conjunction with a kelly (or similar device) in a drill string to close to save mud in the kelly (and mud above the kelly) during the make-up or break-out of drill string joints. In one aspect such a drilling mud saver valve has a tubular housing with an upper threaded end for engaging a device such as a kelly on a drill string and a lower threaded end for engaging a drill pipe member. A ball closure is rotatably mounted in the tubular housing and on one side has a first lug projecting therefrom and on an opposite side has a second lug projecting therefrom. A movable top sleeve within the tubular housing is movable in response to the pressure of drilling fluid pumped into the drill string so that a first dog on the sleeve engages the first lug of the rotatable ball closure to open the valve permitting drilling fluid under pressure to flow down into the drill string. Movement of the sleeve also compresses one or more springs mounted within the tubular housing. Upon cessation of the pumping of drilling fluid the springs are released, and the sleeve elements move downwardly thus disengaging the first dog from the first lug. At this moment, the second dog still has not engaged the second lug of the closure thus the ball closure remains in open position. During this time the drill pipe is still in engagement with the tubular housing via nose and probe pieces. Upon disconnection of the drill pipe, the coil spring pushes the sleeve elements further downward, so that a second dog on the sleeve engages the second lug of the ball closure to rotate the ball closure to a closed position thereby preventing drilling fluid from flowing out from the kelly. During an ensuing joint connection procedure, the mud saver valve remains closed until the joint is made and drilling mud is again pumped down the drill string under pressure.

A mud saver valve of the present invention is installed between the drill kelly and the drill pipe and operates in response to engagement-disengagement of the valve body with the drill pipe as well as in response to the fluid pressure which builds up when the pumps are turned on. The valve remains open even after the pumps are turned off until the drill pipe is disengaged.

More specifically the present invention, in certain embodiments, discloses a mud saver valve for controlling flow of drilling fluid through a drill string, the mud saver valve having in one aspect a housing removably attachable to the drill string, a ball closure rotatably disposed within the housing, the ball closure having a body, a flow channel therethrough, a first body side and a second body side opposite the first body side, a first lug projecting from the first body side and a second lug projecting from the second body side; a sleeve assembly movably disposed within the housing, the sleeve assembly having an outer surface and an inner surface, a first actuator and a second actuator projecting from the inner surface, the first and the second actuators co-operating with the first and the second lugs of the ball closure to cause rotation of the ball closure between its open and closed positions.

It is, therefore, an object of at least certain preferred embodiments of the present invention to provide:

- new, useful, unique, efficient, nonobvious devices for saving drilling mud;
- such devices including a mud saver valve for use below a kelly or other similar device in a drilling operation;
- such devices having a rotatable ball closure moved by a sleeve which itself moves in response to drilling fluid pressure;
- such devices in which release of drilling fluid pressure alone does not result in valve closure; and
- such devices in which disconnection of the valve from a drill string results in movement of the ball closure to close the valve.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that, the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this parent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 14 is longitudinal, view of the lower sleeve element showing the dogs, of the valve of FIG. 1.

FIG. 15 is a cross-sectional view taken along line A—A of FIG. 14.

DETAILED DESCRIPTIONS OF THE PREFERRED EMBODIMENT

Figures 1, 3, 5, 7:
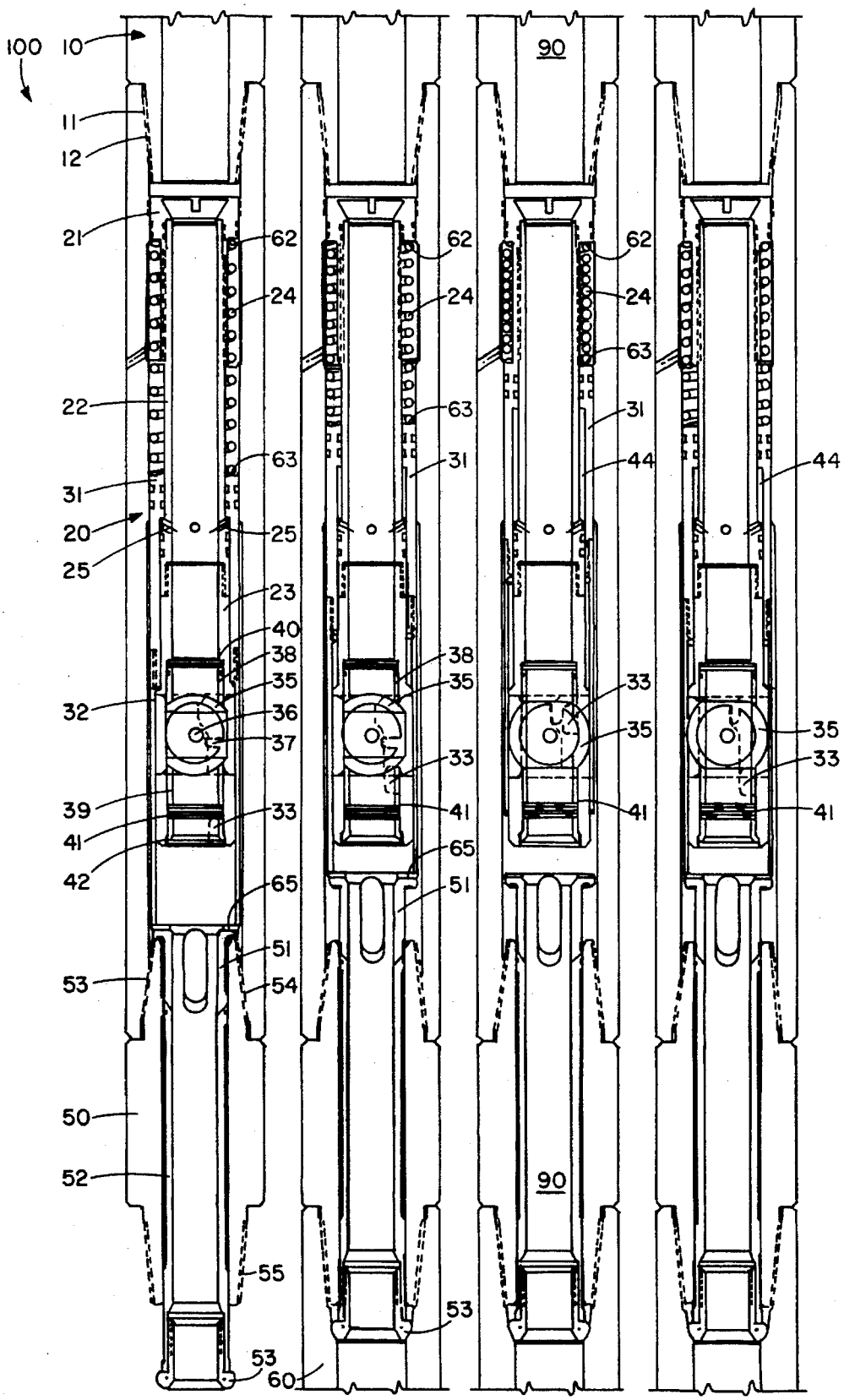
FIGS. 1 and 2 are a longitudinal cross-sectional view of a mud saver valve according to the present invention depicting the valve in closed position and the valve housing disengaged from the drill pipe.
FIGS. 3 and 4 are a longitudinal cross-sectional view of the mud saver valve housing of FIG. 1 in engagement with the drill pipe and the pumps off condition.
FIGS. 5 and 6 are a longitudinal cross-sectional view of the mud saver valve of FIG. 1 depicting the valve in an open position and the pumps running.
FIGS. 7 and 8 are a longitudinal cross-sectional view of the mud saver valve of FIG. 2 depicting the valve in an open position and the pumps off condition.

Referring now to FIG. 1, a mud saver valve 100 of the present invention is shown as interconnected to a drill kelly 10. The mud saver valve 100 has a valve body 20 threaded into the lower end of the kelly 10 through tapered threaded surfaces 11 and 12, the opposite end of the valve body 20 has threads 55 for interconnection to a drill pipe 60. In some cases a wear sub 50 may be interconnected between the valve body 20 and the drill pipe 60.

Figures 2, 4, 6, 8:
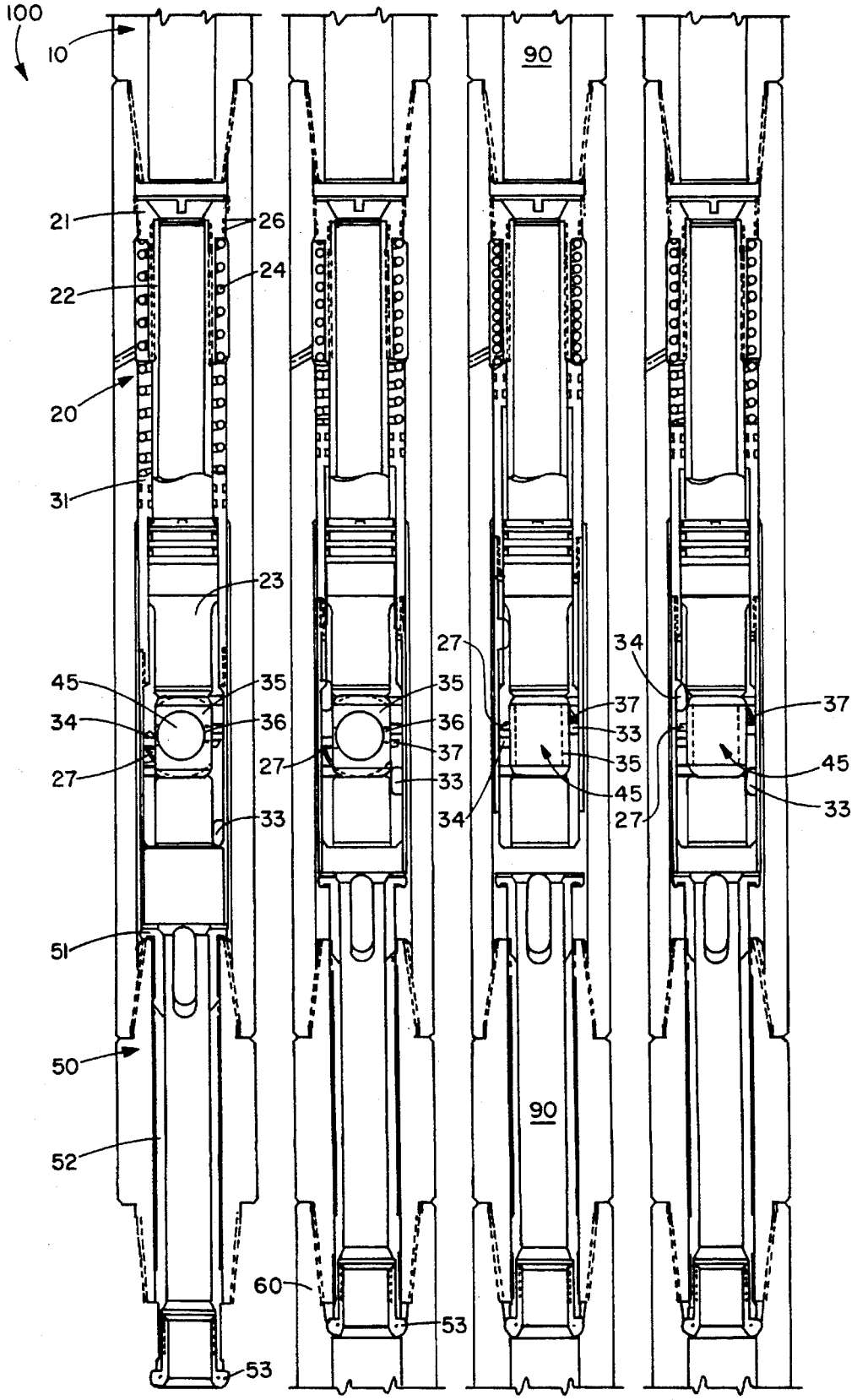

FIG. 1 shows a side view of the ball closure element and FIG. 2 shows the same ball closure element 35 in its closed position with a view of its flow through channel 45. The ball closure element 35 is clearly shown in FIGS. 16 and 17 and will be described in further detail.

Figures 16, 17:
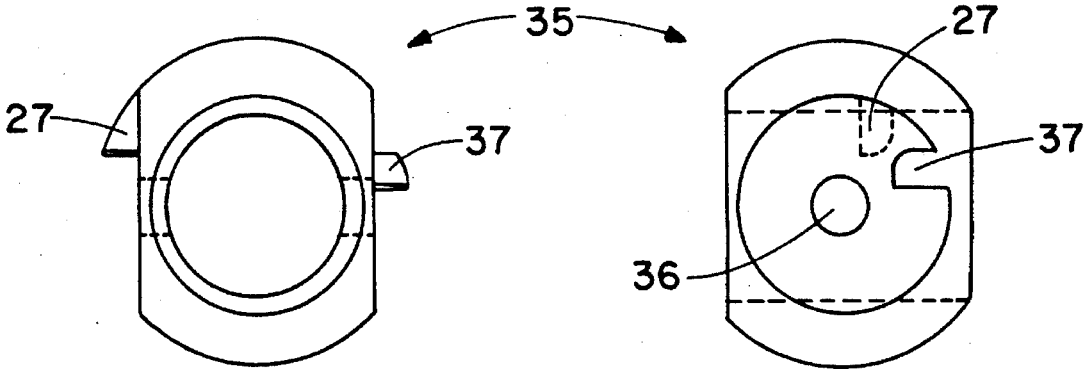
FIG. 16 is an overall view of the ball closure of the valve of FIG. 1 showing the flow channel and the lugs.
FIG. 17 is a side view of the ball closure of the valve of FIG. 1 showing the angular relationship of the lugs.

The mud saver valve of the present invention includes the valve body 20 and four assemblies as will be described herein after. A support assembly includes a top support element 21, a center support element 22, and a bottom support element 23. The top support, center support and the bottom support are threaded together to form a stationary assembly that is in turn threaded to the valve body 20. A sleeve assembly includes an upper sleeve element 31 and a lower sleeve element 32 threaded together to form a unitary structure. The sleeve assembly 31 and 32 form a reciprocating structure and is slidably mounted within the valve body 20 between the exterior of the support assembly and the interior of the valve body. The top support element 21 forms a shoulder 62. A coil spring 24 is placed between the top support and the upper sleeve urging the support assembly and the sleeve assembly away from each other. The coil spring may be a single spring or a series of springs and is placed between a shoulder 62 of the top support and the surface 63 of the upper sleeve. A ball closure element 35 is rotatably supported within the bottom support element 23 and rotates about a hinge pin 36. In FIG. 1 the ball closure is shown in its closed position. A seal tube 38 is placed at the upstream of the ball closure 35 and is urged against the ball closure element by a series of wave springs and shims 40. The wave springs and shims 40 are shown in detail in FIGS. 9 and 10. A detent tube 39, a guide 42 and a series of second wave springs and shims 41 are disposed at the down stream of the ball closure 35 such that the detent tube 39 is urged against the bottom portion of the ball closure element 35. The detent tube positively engages the flat surface of the ball closure element 35 when the ball closure is rotated to an open, full flow position and maintains the ball closure in the open position. The ball closure 35 includes a pair of operating lug 37 and 27, which will be referred to as opening and closing lugs respectively or simply as lugs. The lugs have a triangular cross section and approximates a fragment of a sphere of the ball closure 35. The lugs increase in height toward a center of a flat surface of the ball closure as shown in FIG. 16. The lugs are positioned 90° out of phase with respect to each other. The lower sleeve 32 of the sleeve assembly has a pair of actuators or dogs 33 and 34 as shown in FIGS. 1–8. The dogs coact with the lugs of the ball closure or lug ball 35. Preferably the dogs have a complimentary shape or a cross section to lugs. As will be further explained, the first actuator or the dog 33 engages the first lug 37 to place the ball closure into an open position, the second actuator or the dog 34 engages the second lug 27 to place the ball closure into a close position. The support assembly, more particularly the center support 22 includes four fluid ports 25 which are in fluid communication with a fluid chamber that is formed between the center support 22 and the upper sleeve 31. The fluid chamber 44 is clearly shown in FIGS. 3, 5 and 7. A lower end of the valve assembly includes a probe 51 and a nose element 53. The probe and the nose are threaded together. The valve body 20 is threaded to a drill pipe 60 when the mud saver valve of the present invention is incorporated in a drill string. However in some cases it may be desirable to interconnect a wear sub 50 between the bottom end of the valve body 20 and the drill pipe 60. If the wear sub is utilized then an extension tube 52 should be installed between the probe 51 and the nose 53 to place the nose 53 below the wear sub element 50.

Figure 9:
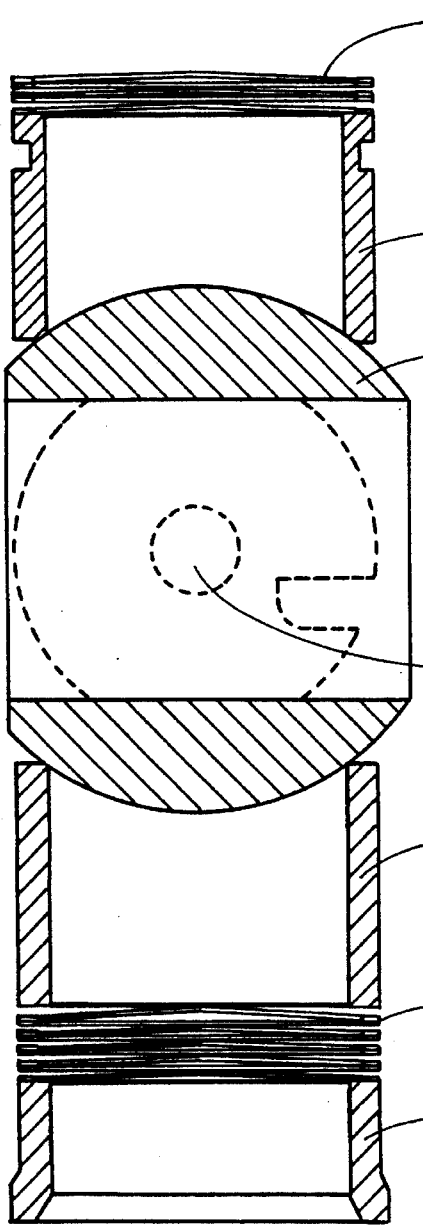
FIGS. 9 and 10 are a cross-sectional view of the ball closure element of the valve of FIG. 1 in a closed position corresponding to FIGS. 1 and 2 and in an open position corresponding to FIGS. 5 and 6, respectively.
Figure 10:
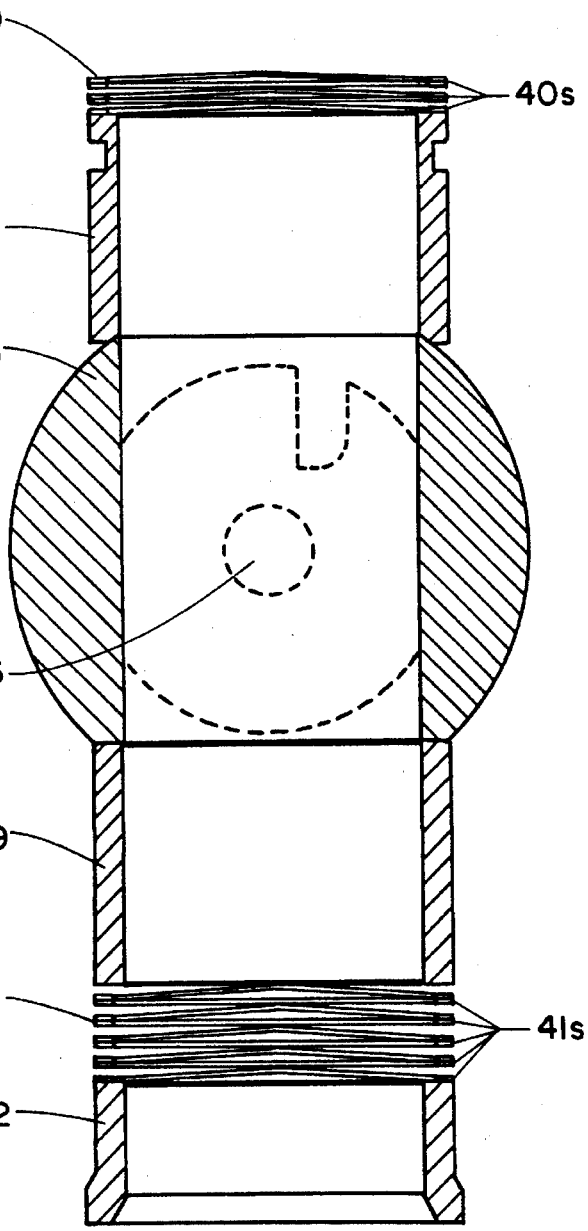
Figure 12:
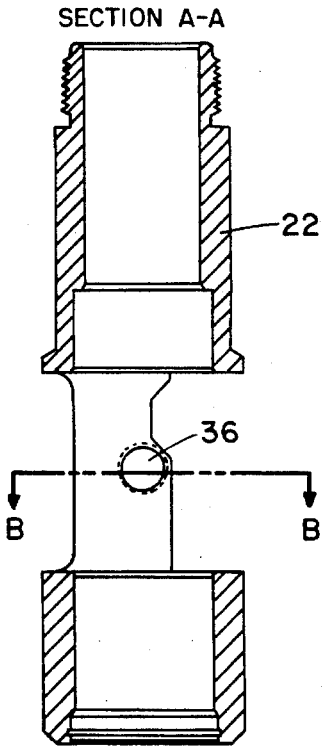
FIG. 12 is a sectional view taken along A—A of FIG. 11.
Figure 13A:
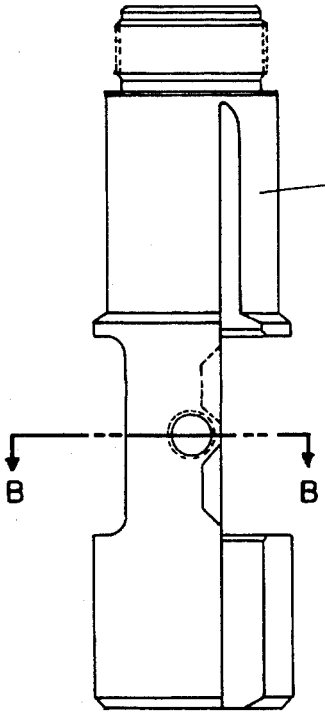
FIG. 13A is a side view of the bottom support which houses the ball closure, of the valve of FIG. 1
Figure 11:
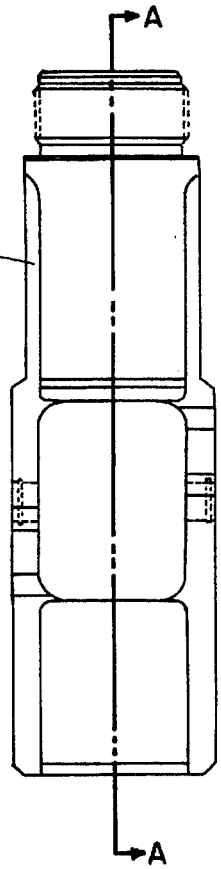
FIG. 11 is a front view of the bottom support which houses the ball closure, of the valve of FIG. 1.
Figure 13:
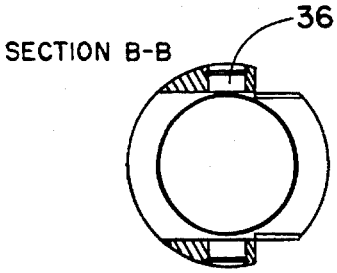
FIG. 13 is cross-sectional view taken along line B—B of FIG. 12.

FIGS. 9 and 10 clearly show the ball closure element assembly 35 along with the seal tube 38, the detent tube 39, the guide 42 and the series of wave springs and shims 40. FIG. 9 shows the ball closure in its closed position during which the wave springs 41 are in a compressed state. When the ball closure 35 is rotated into an open, flow through position, the detent tube 39 is urged against the flat side of the ball closure 35 and keeps the ball closure in a perfectly open alignment so that wire line tools, if required, can pass through the bore of the ball closure 35. FIGS. 11 and 12 show overall views of the bottom support 23 in which the ball closure assembly 35 is rotatably mounted about hinges 36. FIG. 14 shows the lower sleeve 32, of the sleeve assembly and the pair of actuators 33 and 34 extending from its inner surface. Cross-sectional views of the actuators 33 and 34 is clearly shown in FIG. 15. The actuators of the sleeve are positioned 90° out of phase with respect to each other. FIGS. 16 and 17 show the ball closure 35.. The lugs, 27 and 37 are clearly shown in FIG. 16. 37 is the opening lug and 27 is the closing lug. The actuators 33 and 34 of the lower sleeve engages the lugs 37 and 27 respectively. The lug 37 is disposed on a first flat surface of the ball closure element while the lug 27 is disposed on a second flat surface of the ball closure element. Although not discussed, overall assembly includes O-rings and properly designed seals in all the appropriate and necessary locations. One example of such O-rings and seals is shown with numeral 26 in FIG. 2.

The mud saver valve of the present invention is assembled as follows. The top support element 21, the center support element 22 and the bottom support element 23 are threaded together to form a unitary and stationary assembly which is threaded into the valve body 20. The upper sleeve element 31 and the lower sleeve element 32 are threaded together to form an assembly that reciprocates within the space defined between the support assembly and the valve body and is biased away from the support assembly by a coil spring 24 which is disposed between the shoulder 62 defined by the top support and the top surface 63 of the upper sleeve member 31. The support assembly and the sleeve assembly are co-axially mounted in the valve body and the sleeve assembly reciprocates along the support assembly in response to connecting the mud saver valve assembly into the drill pipe as well as in response to the fluid pressure that acts in the annular space 44 when the pumps are turned on. The ball closure element 35 is located inside the bottom support 23 and is hinged to the bottom support via two hinge pins 36. FIGS. 1 and 3 show the ball closure element 35 in its closed position in the side view while FIGS. 5 and 7 show the ball closure element 35 in its open position from a side view. FIGS. 2 and 4 show the ball closure element 35 in closed position from the view that shows a flow through channel 45. FIGS. 6 and 8 show the ball closure 35 in its open position through the front view.

As shown in FIGS. 9 and 10, the seal tube 38 along with the wave springs and the shims 40 and the detent tube 39 and the guide 42 along with the wave springs and the shims 41 are packed in the upper and lower downstream of the ball closure assembly 35. Referring to FIGS. 1–8 the probe 51 and the nose 53, optionally wear sub 50, are installed by threading on to the bottom end of the valve bottom such that nose 53 engages and is moved by a drill pipe when the drill pipe 60 is threaded to the bottom of the valve body 20 or optionally, to the bottom of wear sub 50. The extension tube 52 is installed between the probe and the nose if the wear sub 50 is utilized. If desired, the probe 51 and the extension tube 52 may be one piece. When the mud saver valve assembly is put together the coil spring 24 initially presses the sleeve assembly downward wherein the sleeve assembly abuts against the shoulder 65 formed on the probe 51. This position is shown in FIG. 1 prior to the valve body engaging the drill pipe 60. As shown in FIGS. 1 and 2 the opening dog 33 is spaced away from the opening lug 37 of the ball closure element while closing dog 34, FIG. 2, engages the closing lug 27 or extension of the ball closure assembly 35 and maintains the ball closure in its closed position, during which no flow takes place through the mud saver valve assembly.

The operation of the mud saver valve assembly is as follows.

The valve body 20 either directly or through the optional wear sub 50 is threaded onto the drill pipe 60 and is incorporated into the drill string between the kelly 10 and the drill pipe 60. Please note that the threading of the mud saver valve body to the bottom of the kelly assembly 10 causes no changes in the relative positions of the components of the mud saver valve assembly. Upon threading the drill pipe onto the bottom of the valve body forces the nose 53 and the probe 51 to move upwardly as shown in FIGS. 3 and 4. This upward movement is approximately 2.3 inches however it could be more or less depending on the design parameters of the mud saver valve. The probe 51 in turn pushes the lower sleeve, subsequently upper sleeve upward by the same distance namely 2.3 inches. Although the opening dog 33 moves upwardly it does not travel enough distance to engage the opening lug 37 of the ball closure element 35. When the pumps are engaged, FIGS. 5 and 6, mud drilling fluid starts flowing through the kelly assembly 10 into the center support 22 and the bottom support 23, thus causing an increase in fluid pressure inside the center support and the bottom support. This increase in fluid pressure is transmitted through the openings or ports 25 into the fluid chamber 44 that is defined between the center support 22 and the upper sleeve element 31 and forces the sleeve assembly to move upwardly and compresses the coil spring 24 that is disposed between the support assembly and the sleeve assembly. This positioning is clearly shown in FIGS. 5 and 6 wherein the coil spring 24 is in compressed state due to the fluid pressure that is created in the chamber 44.

The upper sleeve is pushed upwardly until it contacts the bottom end of the top support via coil spring 24 when the fluid pressure in this chamber 44 exceeds a specific amount. The specific amount of fluid pressure can be selected based on the overall design and operational parameters of the assembly. Furthermore, any desirable dimensions and pressures can be chosen specifically to activate and move the upper sleeve against the coil spring.

Now attention is directed to FIGS. 5, 6, 7, and 8. The upward movement of the upper sleeve and the lower sleeve is caused by the increase in fluid pressure which directly acts on the upper sleeve. The size of this movement can be any desired amount and will depend on the overall size of the assembly. Following the upward movement of the sleeve, the opening dog 33 engages the opening lug or extension 37 of the ball closure element 35 and rotates the ball closure element into its open position establishes fluid flow through the mud saver valve into the lower half of the valve body and into the drill pipe. In this instance, as is clearly shown in FIGS. 6 and 8, the closing dog 34 is out of engagement with the closing lug of the ball closure element 27. Once the ball closure element 35 is rotated into an open full flow position, the wave springs and shim assembly 41, which was previously under compression, pushes the detent tube 39 upwardly against the flat surface of the ball closure element and rests against the flat surface and maintains the ball closure 35 in, perfectly open alignment position. It is important to maintain the ball closure 35 in the open position so that wire line tools can be passed through the bore of the lug ball 35. With the pumps running, drilling normally continues until the drill bit progresses a certain distance, for example about 30 feet. The pumps are then stopped and the kelly is picked up until the top of the drill pipe is at least a couple of feet above the rig floor and the slips are set in place. With the pumps turned off, the pressure inside the mud saver valve assembly drops significantly. Referring to FIGS. 7 and 8, upon cessation of the fluid pressure the forces acting in the chamber 44 decreases thus moving the sleeve assembly downward under the influence of the coil spring 24. As it is clearly shown in FIGS. 7 and 8, in this position the lower end of the lower sleeve 32 abuts against the top shoulder of the probe element 51. The probe and the nose can not move any further downward direction since the drill pipe is still connected and abuts against the nose piece. Because the probe 51 can not move any further in a downward direction the lower sleeve can not move any further in a downward direction therefore closing dog 34 is in disengagement with the closing lug or extension of the lug ball 35 thus the valve still remains open at this moment. In order to continue with the drilling operation, the drill pipe is now disconnected from the valve body. With the drill pipe disconnected, the spring 24 pushes the upper sleeve and the lower sleeve along with the probe and the nose in a downward position into the position shown in FIGS. 1 and 2. The closing dog 34 engages with the closing lug of the ball closure element and rotates the ball closure element into a closed position as shown in FIGS. 1 and 2.

So it is clearly shown that the ball closure valve is automatically rotated into the closed position immediately upon disengagement of the mud saver valve body from the drill pipe. This closing action does not require any exterior manipulation or additional mechanism to manually or automatically rotate the ball closure valve but is only activated upon the disengagement of the valve body from the drill pipe. This is important because if the ball closure is not automatically closed off upon disengagement, drilling fluid that is accumulated in the kelly will be lost thus making the economic and environmental cost very high. Since the new drill pipe is added approximately every 30 feet increments, the loss of drilling fluid can be numerous when it is considered that between 20 and 40 gallons of fluid is lost every time a joint is added. The mud saver valve of the present invention automatically closes upon disengagement and preserves the mud drilling fluid that has accumulated in the kelly as new drill pipe sections are added during drilling. An important aspect of this mud saver valve is the fact that it is very compatible with the drilling operation and does not require any exterior manipulation or intervention for the operation of the valve and is automatically turned on during full flow conditions and with engagement of the valve body with the drill pipe. However when the pumps are turned off and the flow is stopped the ball closure remains in open condition allowing full access to the flow through bore of the ball closure element so that wire line tools, if required, can pass through the bore of the ball closure eliminating the use of any special tools or cumbersome manipulation in order to allow the wire line though it. For instance, if the drill pipe becomes stuck while drilling, a wireline instrument that can detect the point at which the sticking occurs is run. After that an explosive charge may be run and fired in the first connection above the stuck point. This process loosens the connection and the drill pipe above that connection can be retrieved rather than lost in the hole. So it is important for the mud saver valve to remain open even after pumps are turned off so that wireline tools necessary can be passed through the bore thereof. Other devices used for this service may require special tools to pull the valve internals or break through a metal cap or run lock open devices as clearly known in the prior art. Furthermore the ball closure element immediately closes upon engagement of the closure dog with the closure lug of the ball closure element when the valve body is removed out of engagement with the drill pipe therefore preventing the spill of the drilling fluid and resulting in an enormous economic savings and convenience.

Another reason it is important that the ball closure element remains open after the pumps are turned off before the valve body is disengaged from the drill pipe is that if during the drilling operation formation fluids enter the well bore they must be circulated out using procedures which require continuous, accurate pressure measurements with the pumps operating slowly or occasionally stopped. The fact that the mud saver valve of the present invention remains fully open during this low flow or no flow condition it does not interfere with the pressure measurements that must be taken during the conditions that are described above.

So it is clearly shown that the mud saver valve of the present invention is very efficient in operation and does not require any outside tools or manipulation to operate the ball into the open or closed position.

To summarize, the ball valve remains closed during the joining operation of the body to the bottom of the kelly. When the valve body is interconnected to the drill pipe the sleeve element moves upwardly compressing the spring but the ball closure remains in the closed position. When the pumps are turned on, increased flow pressure causes further upward movement of the sleeve element thus compressing the spring 24 and causing the ball closure element into an open position in response to the increased fluid pressure and provides full flow through the ball closure element. When the pumps are turned off, the ball valve remains in an open position for variety of purposes and needs that may arise even though the valve body still remains interconnected to the drill pipe. Upon disconnection from the drill pipe the valve closure automatically is turned to the closed position and immediately blocks the flow so that the drilling fluid is not lost due to kelly being disengaged from the drill pipe.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized.

What is claimed is:

1. A mud saver valve for controlling flow of drilling fluid through a drill string, the mud saver valve comprising:

a housing removably attachable to the drill string;

a ball closure rotatably disposed within the housing, the ball closure having a body, a flow channel therethrough, a first body side and a second body side opposite the first body side, a first lug projecting from the first body side and a second lug projecting from the second body side;

a sleeve assembly movably disposed within the housing, the sleeve assembly having an outer surface and an inner surface, a first actuator and a second actuator projecting from the inner surface, the first and second actuators co-operating with the first and the second lugs of the ball closure to rotate the ball closure between open and closed positions;

biasing means disposed within the housing, acting upon the sleeve assembly; and means for responding to fluid pressure conditions in the drill string, whereby the ball closure is movable to an open position.

2. The mud saver valve of claim 1 wherein:

the housing is of tubular structure and includes a first end removably attachable to a kelly and a second end removably attachable to the drill string.

3. The mud saver valve of claim 1 wherein:

the first lug and the second lug are disposed 90° out of phase with respect to each other.

4. The mud saver valve of claim 1 wherein:

the first body side and the second body side each have a center, and the first lug and the second lug increase in height towards the center of the first body side and the second body side respectively.

5. The mud saver valve of claim 4 wherein:

an outer surface of the first lug and of the second lug corresponds to a spherical shape of the ball closure.

6. The mud saver valve of claim 1 wherein:

the first and the second lugs along with the first and second actuators have a substantially triangular cross-section co-operating with each other.

7. The mud saver valve of claim 1 further comprising:

a detent tube movably disposed within the sleeve assembly, the detent tube biased into constant engagement with the ball assembly to maintain the ball assembly in an open or closed position.

8. The mud saver valve of claim 1 wherein the sleeve assembly comprises:

an upper sleeve element;

a lower sleeve element removably attached to the upper sleeve element and movable with the upper sleeve element within the housing in response to engagement of the housing with the drill string and in response to fluid pressure within the housing effecting rotation of the ball closure between open and closed positions.

9. A mud saver valve for controlling flow of drilling fluid through a drill string, the mud saver valve comprising:

a tubular housing removably attachable to the drill string;

a support assembly mounted within the tubular housing;

a sleeve assembly movably disposed within the tubular housing, the sleeve assembly co-operating with the support assembly and forming a fluid chamber there between;

the sleeve assembly having an outer surface and an inner surface, a first actuator and a second actuator projecting from the inner surface, biasing means disposed between the support assembly and the sleeve assembly movably interconnecting the two assemblies;

a ball closure rotatably disposed within the housing, the ball closure having a body, a flow channel therethrough, a first body side and a second body side opposite the first body side, a first lug projecting from the first body side and a second lug projecting from the second body side; and the first actuator and second actuator co-acting with the first lug and the second lug of the ball closure to rotate the ball closure between open and closed positions in response to fluid pressure in the fluid chamber and co-action of the tubular housing with the drill string.

10. The mud saver valve of claim 9 wherein:

the tubular housing includes a fitting at an end opposite the drill string to removably attach the housing to a kelly.

11. The mud saver valve of claim 9 wherein:

the support assembly houses the ball closure and includes:

a top support removably attached to the tubular housing;

a center support removably attached to the top support; and a bottom support removably attached to the center support forming a unitary structure with the top and center supports.

12. The mud saver valve of claim 9 wherein:

the sleeve assembly includes an upper sleeve element along with the support assembly defining a fluid chamber therebetween, a lower sleeve element removably attached to the upper sleeve element and forming a unitary structure therewith such that the sleeve assembly moves within said tubular housing along the support assembly.

13. The mud saver valve of claim 9 further comprising:

a detent tube movably disposed within the sleeve assembly, the detent tube biased into constant engagement with the ball assembly to maintain the ball assembly in an open or closed position.

14. The mud saver valve of claim 9 wherein:

the first lug and the second lug are disposed 90° out of phase with respect to each other.

15. The mud saver valve of claim 9 wherein:

the first body side and the second body side each have a center; and the first lug and the second lug increase in height towards the center of the first body side and of the second body side respectively.

16. The mud saver valve of claim 15 wherein:

an outer surface of the first and of the second lug approximates a spherical shape of the ball closure.

17. The mud saver valve of claim 9 wherein:

the first and the second lugs along with the first and second actuators have a substantially triangular cross-section co-operating with each other.

18. The mud saver valve of claim 9 wherein:

the support assembly and the sleeve assembly are co-axial with respect to each other.

19. The mud saver valve of claim 18 wherein:

the sleeve assembly is disposed exteriorly of the support assembly and reciprocates within a space defined between the support assembly and the tubular housing.

20. A mud saver valve for installation at an end of a drill kelly for controlling flow of drilling fluid through a drill string, the mud saver valve comprising:

a tubular housing removably attachable to the kelly at a first end and attachable to the drill string at a second opposite end;

a support assembly disposed inside the tubular housing and removably attached to the tubular housing at the first end, the support assembly having a top support element, a center support element and a bottom support element, the three support elements coupled together, the bottom support element housing a ball closure;

a sleeve assembly movably disposed inside the tubular housing, the sleeve assembly co-operating with the support assembly and defining a fluid chamber therebetween, the sleeve assembly having an upper and lower sleeve elements;

the lower sleeve element having an outer surface and an inner surface, a first actuator and a second actuator projecting from the inner surface;

a biasing element disposed within the tubular housing and between the support assembly and the sleeve assembly for interconnecting the support and the sleeve assemblies;

a ball closure rotatably disposed within the tubular housing inside the bottom support element, the ball closure having a body, a flow channel therethrough, a first body side and a second body side opposite the first body side, a first lug projecting from the first body side and a second lug projecting from the second body side; and the first actuator and the second actuator coacting with the first lug and the second lug to rotate the ball closure between an open and closed position.

21. The mud saver valve of claim 20 further comprising:

a detent tube movably disposed within the bottom support element, the detent tube biased into constant engagement with the ball assembly to maintain the ball assembly in an open or closed position.

22. The mud saver valve of claim 20 further comprising:

a probe removably attached to the tubular housing; and a nose removably attached to the probe at a first end and engaging the drill string at a second end.

23. The mud saver valve of claim 22 further comprising:

a wear sub removably attached to the tubular housing at a first end and removably attached to the drill string at a second end.

24. The mud saver valve of claim 23 further comprising:

an extension tube removably mounted between the probe and the nose.

25. The mud saver valve of claim 20 wherein:

the support assembly and the sleeve assembly are co-axial with respect to each other.

26. The mud saver valve of claim 25 wherein:

the sleeve assembly is disposed exteriorly of the support assembly and reciprocates within a space defined between the support assembly and the tubular housing.

* * * * *